US008246388B2

(12) United States Patent
Chen et al.

(10) Patent No.: US 8,246,388 B2
(45) Date of Patent: Aug. 21, 2012

(54) USB PORT, USB PLUG, AND CONNECTION STRUCTURE THEREOF

(75) Inventors: Yin-Hua Chen, Mission Viejo, CA (US); Ren Su, Santa Ana, CA (US)

(73) Assignee: I/O Interconnect, Ltd., Santa Ana, CA (US)

( * ) Notice: Subject to any disclaimer, the term of this patent is extended or adjusted under 35 U.S.C. 154(b) by 287 days.

(21) Appl. No.: 12/817,394

(22) Filed: Jun. 17, 2010

(65) Prior Publication Data

US 2011/0294354 A1 Dec. 1, 2011

Related U.S. Application Data

(60) Provisional application No. 61/347,901, filed on May 25, 2010.

(51) Int. Cl.
*H01R 24/00* (2006.01)

(52) U.S. Cl. ..... 439/660

(58) Field of Classification Search ..... 439/660, 439/630, 607.01, 607.35, 218, 79, 74, 541.5, 439/540.1
See application file for complete search history.

(56) References Cited

U.S. PATENT DOCUMENTS

| | | | | |
|---|---|---|---|---|
| 7,393,247 | B1 * | 7/2008 | Yu et al. | 439/638 |
| 7,537,488 | B2 * | 5/2009 | Iwakawa | 439/660 |
| 7,559,805 | B1 * | 7/2009 | Yi et al. | 439/660 |
| 7,695,318 | B1 * | 4/2010 | Wang et al. | 439/607.01 |
| 7,806,704 | B2 * | 10/2010 | Miyoshi et al. | 439/108 |
| 7,841,894 | B2 * | 11/2010 | Gong et al. | 439/541.5 |
| 7,887,370 | B2 * | 2/2011 | Chen et al. | 439/607.35 |
| 8,011,968 | B2 * | 9/2011 | Lai et al. | 439/660 |
| 8,100,724 | B2 * | 1/2012 | Lin et al. | 439/630 |
| 8,100,725 | B2 * | 1/2012 | Su et al. | 439/660 |

* cited by examiner

*Primary Examiner* — Alexander Gilman

(57) ABSTRACT

A USB port includes a casing, first pins and second pins. The casing includes outer walls and a pillar. An accommodation space is formed between the outer walls. The pillar is disposed in the accommodation space. The casing has an opening exposing the pillar, and the pillar has a first surface, a second surface adjacent to the first surface, a third surface opposite to the first surface, and a fourth surface opposite to the second surface. The first pins are disposed at the first surface and the third surface, and the first pins conform to the USB 2.0 specification and the USB 3.0 specification. The second pins are disposed at the second surface and the fourth surface, and the second pins conform to the USB 3.0 specification. A USB plug for joined with the USB port is also provided.

20 Claims, 5 Drawing Sheets

USB PORT, USB PLUG, AND CONNECTION STRUCTURE THEREOF

CROSS-REFERENCE TO RELATED APPLICATIONS

This application is based upon and claims the benefit of priority from the prior U.S. Provisional Patent Application No. 61/347,901, filed May 25, 2010, the entire contents of which are incorporated herein by reference.

BACKGROUND

1. Field of the Invention

The present invention relates to USB connectors conforming to a USB 2.0 specification and a USB 3.0 specification, and more particularly to a USB port, a USB plug and a connection structure thereof.

2. Description of the Related Art

Universal serial bus (USB) is a specification to establish communication between devices and a host controller (e.g. personal computers). USB is intended to replace many varieties of serial and parallel ports. USB can connect computer peripherals such as mice, keyboards, digital cameras, printers, personal media players, flash drives, and external hard drives. For many of those devices, USB has become the standard connection means. USB was designed for personal computers, but it has become commonplace on other devices such as smartphones, personal digital assistants (PDAs) and video game consoles, and as a power cord between a device and an AC adapter plugged into a wall plug for charging.

USB 1.0 released in 1996 and USB 1.1 released in 1998 provide a Low-Speed 1.5 Mbps subchannel for keyboards and mice and a Full-Speed channel at 12 Mbps. Hi-Speed USB 2.0 released in 2001 jumps the top rate to 480 Mbps, while SuperSpeed USB 3.0 released in 2008 provides a huge 10× increase to 4.8 Gbps.

Currently, USB 2.0 is the most common and widely used interface, but USB 3.0 can provide amazing speed. In order to let USB 3.0 become popular, it is important to provide USB connectors which conform to a USB 2.0 specification and a USB 3.0 specification.

BRIEF SUMMARY

The present invention provides a USB port conforming to a USB 2.0 specification and a USB 3.0 specification and having a compact size.

The present invention further provides a USB plug conforming to the USB 2.0 specification and the USB 3.0 specification and having a compact size.

The present invention further provides a connection structure of USB port and USB plug to achieve a compact size.

To achieve at least one of the above-mentioned advantages, the present invention provides a USB port including a casing, a plurality of first pins and a plurality of second pins. The casing includes a plurality of outer walls and a pillar, and an accommodation space is formed between the outer walls. The pillar is disposed in the accommodation space. The casing has an opening exposing the pillar, and the pillar has a first surface, a second surface adjacent to the first surface, a third surface opposite to the first surface, and a fourth surface opposite to the second surface. The first pins are disposed at the first surface and the third surface, and the first pins conform to the USB 2.0 specification and the USB 3.0 specification. The second pins are disposed at the second surface and the fourth surface, and the second pins conform to the USB 3.0 specification.

In one embodiment of the present invention, a number of the first pins is four, wherein two of the first pins are disposed at the first surface and the other two first pins are disposed at the third surface.

In one embodiment of the present invention, a number of the second pins is four, wherein two of the second pins are disposed at the second surface, and the other two second pins are disposed at the fourth surface.

In one embodiment of the present invention, each of the first pins and the second pins has a first end and a second end. The first ends of the first pins are disposed at the first surface and the third surface, the first ends of the second pins are disposed at the second surface and the fourth surface, and the second ends of the first pins and the second pins are extended outside the casing.

In one embodiment of the present invention, a part of each of the first pins and the second pins outside the casing has a bending portion.

In one embodiment of the present invention, the first pins include a D+ pin, a D− pin, a Vbus pin and a ground pin.

In one embodiment of the present invention, the second pins include a SSRX+ pin, a SSRX− pin, a SSTX+ pin and a SSTX− pin.

To achieve at least one of the above-mentioned advantages, the present invention provides a USB plug including a connection head, a plurality of third pins and a plurality of fourth pins. The connection head has a cavity. The cavity has a first side wall, a second side wall adjacent to the first side wall, a third side wall opposite to the first side wall, and a fourth side wall opposite to the second side wall. The third pins are disposed at the first side wall and the third side wall, and the third pins conform to the USB 2.0 specification and the USB 3.0 specification. The fourth pins are disposed at the second side wall and the fourth side wall, and the fourth pins conform to the USB 3.0 specification.

In one embodiment of the present invention, a number of the third pins is four, wherein two of the third pins are disposed at the first side wall, and the other two third pins are disposed at the third side wall.

In one embodiment of the present invention, a number of the fourth pins is four, wherein two of the fourth pins are disposed at the second side wall, and the other two fourth pins are disposed at the fourth side wall.

In one embodiment of the present invention, the third pins include a D+ pin, a D− pin, a Vbus pin and a ground pin.

In one embodiment of the present invention, the fourth pins include a SSRX+ pin, a SSRX− pin, a SSTX+ pin and a SSTX− pin.

In one embodiment of the present invention, the USB plug further includes a holder holding the connection head, wherein the holder has at least one locating part.

In one embodiment of the present invention, the locating part is a locating hook.

To achieve at least one of the above-mentioned advantages, the present invention provides a connection structure of USB port and USB plug including the above-mentioned USB port and the above-mentioned USB plug. The connection head is inserted into the accommodation space and the cavity of the connection head accommodates the pillar. The first side wall corresponds to the first surface of the pillar, the second side wall corresponds to the second surface of the pillar, the third side wall corresponds to the third surface of the pillar, and the fourth side wall corresponds to the fourth surface of the pillar.

The third pins are respectively connected with the first pins, and the fourth pins are respectively connected with the second pins.

In one embodiment of the present invention, the first pins comprise a first D+ pin, a first D− pin, a first Vbus pin and a first ground pin, the third pins respectively comprise a second D+ pin, a second D− pin, a second Vbus pin and a second ground pin, the first D+ pin and the second D+ pin are connected with each other, the first D− pin and the second D− pin are connected with each other, the first Vbus pin and the second Vbus pin are connected with each other, and the first ground pin and the second ground pin are connected with each other.

In one embodiment of the present invention, the second pins comprise a first SSRX+ pin, a first SSRX− pin, a first SSTX+ pin and a first SSTX− pin, the fourth pins comprise a second SSRX+ pin, a second SSRX− pin, a second SSTX+ pin and a second SSTX− pin, the first SSRX+ pin and the second SSRX+ pin are connected with each other, the first SSRX− pin and the second SSRX− pin are connected with each other, the first SSTX+ pin and the second SSTX+ pin are connected with each other, and the first SSTX− pin and the second SSTX− pin are connected with each other.

In one embodiment of the present invention, the connection structure further includes a shell, wherein the USB port is fixed at a side wall of the shell, the USB plug further includes a holder for holding the connection head, the holder has at least one first locating part, and the side wall of the shell has at least one second locating part joined with the first locating part.

In one embodiment of the present invention, the first locating part is a locating hook, and the second locating part is a locating hole.

The USB port and the USB plug of the present invention conform to the USB 2.0 specification and the USB 3.0 specification. Moreover, the USB port has the compact size due to the first pins and the second pins being disposed around the pillar of the casing. The USB plug has the compact size due to the third pins and the fourth pins being disposed around the cavity of the connection head. Therefore, the connection structure of USB port and USB plug can achieve the compact size.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
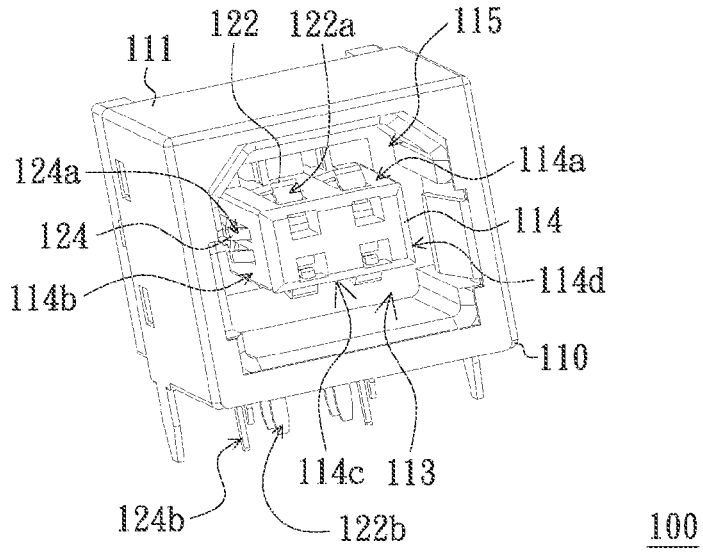
FIG. 1 is a schematic three-dimensional view of a USB port according to an embodiment of the present invention.
Figure 2:
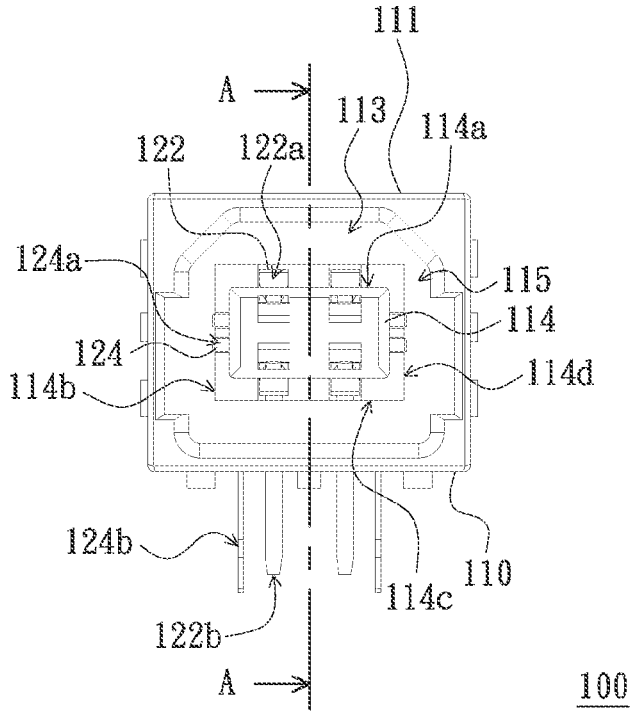
FIG. 2 is a schematic side view of the USB port of FIG. 1.
Figure 3:
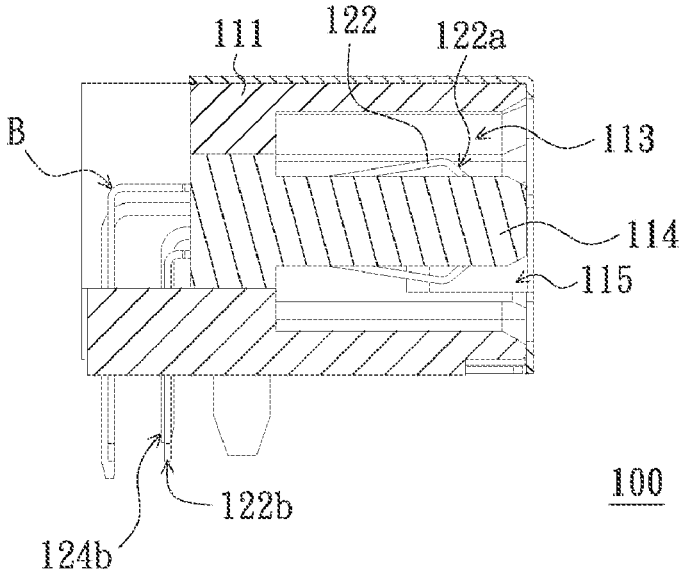
FIG. 3 is a cross sectional view along A-A' line of FIG. 2.
Figure 4:
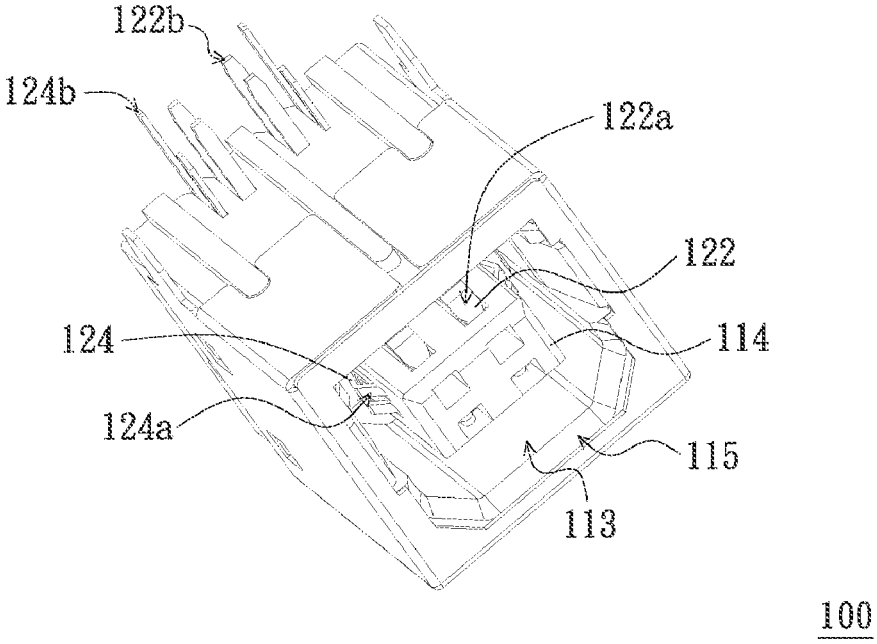
FIG. 4 is another three-dimensional view showing another view angle of the USB port of FIG. 1.

FIG. 1 is a schematic three-dimensional view of a USB port according to an embodiment of the present invention, FIG. 2 is a schematic side view of the USB port of FIG. 1, FIG. 3 is a cross sectional view along A-A' line of FIG. 2, and FIG. 4 is another three-dimensional view showing another view angle of the USB port of FIG. 1. Referring to FIGS. 1 to 4, the USB port 100 of the present embodiment may be applied to some electric products such as computers, multimedia players, etc. The USB port 100 includes a casing 110, a plurality of first pins 122 and a plurality of second pins 124. The casing 110 includes a plurality of outer walls 111 and a pillar 114, and an accommodation space 113 is formed between the outer walls 111. The pillar 114 is disposed in the accommodation space 113. The casing 110 has an opening 115 exposing the pillar 114, and the pillar 114 has a first surface 114*a*, a second surface 114*b* adjacent to the first surface 114*a*, a third surface 114*c* opposite to the first surface 114*a*, and a fourth surface 114*d* opposite to the second surface 114*b*. The first pins 122 are disposed at the first surface 114*a* and the third surface 114*c*, and the first pins 112 conform to a USB 2.0 specification and a USB 3.0 specification. The second pins 124 are disposed at the second surface 114*b* and the fourth surface 114*d*, and the second pins 124 conform to the USB 3.0 specification.

In the present embodiment, a number of the first pins 122 is, for example, four, wherein two of the first pins 112 may be disposed at the first surface 114*a* and the other two first pins 112 may be disposed at the third surface 114*c*. The first pins 122 may include a D+ pin (first D+ pin), a D− pin (first D− pin), a Vbus pin (first Vbus pin) and a ground pin (first ground pin). The D− pin and the Vbus pin may be disposed at the first surface 114*a*, the D+ pin and the ground pin may be disposed at the third surface 114*c*, and the D+ pin is opposite to the D− pin. The D+ pin, the D− pin, the Vbus pin and the ground pin are known by one skilled in the art, so detailed description thereof will be omitted. Moreover, a number of the second pins 124 is, for example, four, wherein two of the second pins 124 may be disposed at the second surface 114*b*, and the other two second pins 124 may be disposed at the fourth surface 114*d*. The second pins 124 may include a SSRX+pin (first SSRX+ pin), a SSRX− pin (first SSRX− pin), a SSTX+ pin (first SSRX− pin) and a SSTX− pin (first SSTX− pin). The SSRX+ pin and the SSRX− pin may be disposed at the second surface 114*b*, and the SSTX+ pin and the SSTX− pin may be disposed at the fourth surface 114*d*. The SSRX+ pin, the SSRX− pin, the SSTX+ pin and the SSTX− pin are known by one skilled in the art, so detailed description thereof will be omitted.

The first pins 122 respectively have a first end 122*a* and a second end 122*b*, while the second pins 124 respectively have a first end 124*a* and a second end 124*b*. The first ends 122*a* of the first pins 122 are disposed at the first surface 114*a* and the third surface 114*c*, the first ends 124*a* of the second pins 124 are disposed at the second surface 114*b* and the fourth surface 114*d*, and the second ends 122*b* and 124*b* of the first pins 122 and the second pins 124 are extended outside the casing 110. Moreover, a part of each of the first pins 122 and the second pins 124 outside the casing 110 may have a bending portion B. The second ends 122*b* and 124*b* may be electrically connected with a circuit unit of an electric product equipped with the USB port 100. The first ends 122*a* and 122*b* are suitable for being connected with pins of a USB plug to be electrically connected with another electric product.

In the present embodiment, the first pins 122 and the second pins 124 are disposed around the pillar 114, not disposed in a same plane, so a width of the USB port 100 can be reduced. Therefore, the USB port 100 of the present embodiment has a compact size.

Figure 5:
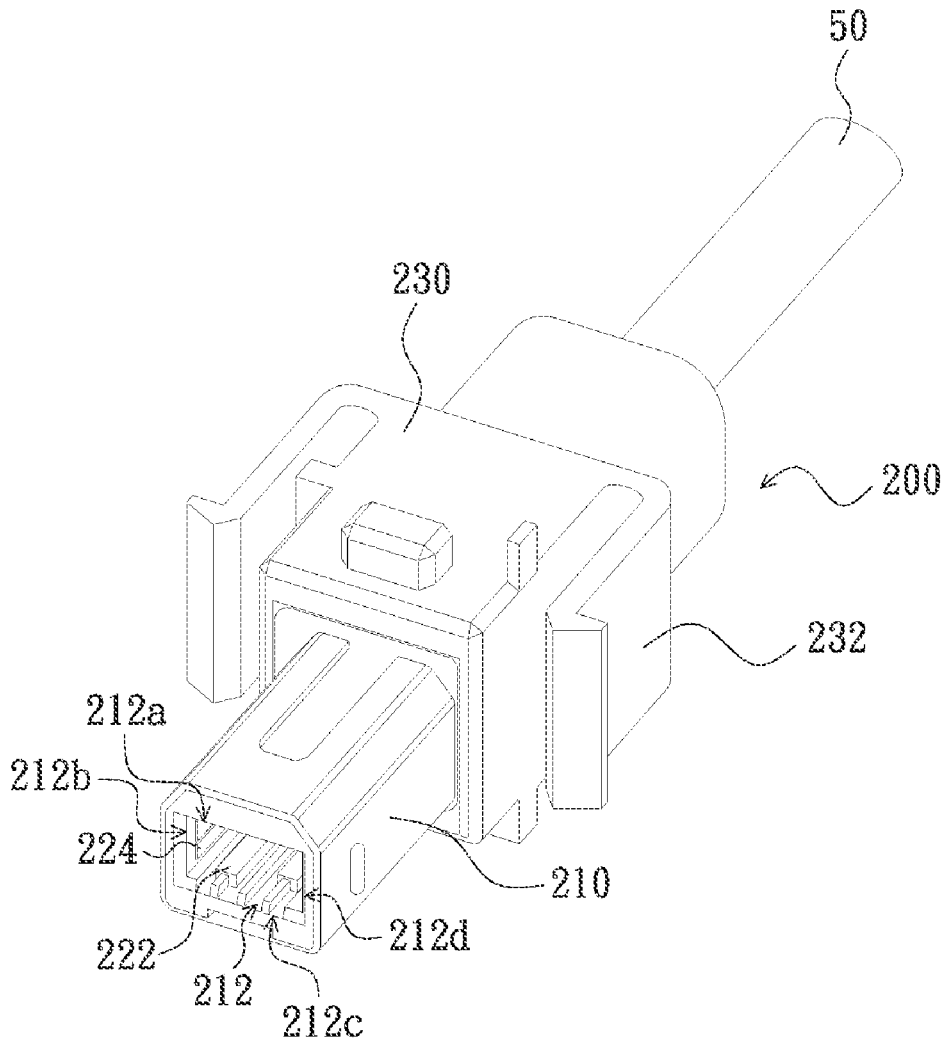
FIG. 5 is a schematic three-dimensional view of a USB plug according to another embodiment of the present invention.
Figure 6:
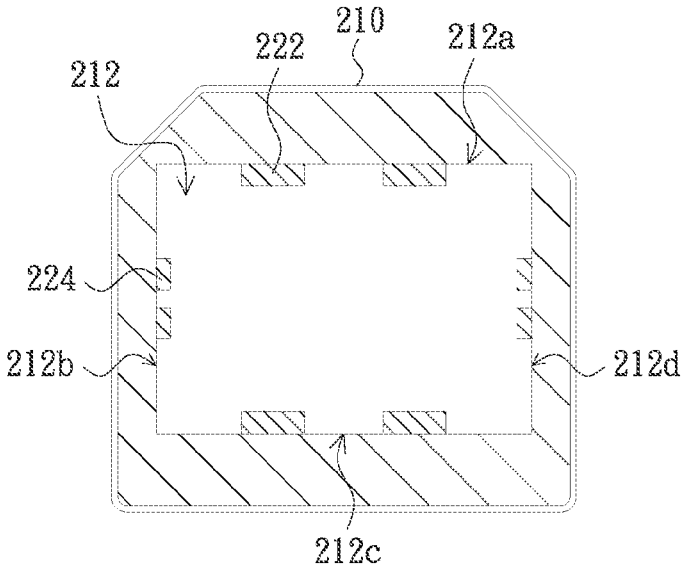
FIG. 6 is a schematic side view of the USB plug of FIG. 5.

FIG. 5 is a schematic three-dimensional view of a USB plug according to another embodiment of the present invention, and FIG. 6 is a schematic side view of the USB plug of FIG. 5, wherein a holder is not shown in FIG. 6. Referring to FIGS. 5 and 6, the USB plug 200 of the present embodiment may be connected with an end of a USB cable 50 and is suitable for being joined with the above-mentioned USB port 100. The USB plug 200 includes a connection head 210, a plurality of third pins 222 and a plurality of fourth pins 224. The connection head 210 has a cavity 212. The cavity 212 has a first side wall 212*a*, a second side wall 212*b* adjacent to the first side wall 212*a*, a third side wall 212*c* opposite to the first side wall 212*a*, and a fourth side wall 212*d* opposite to the second side wall 212*b*. The third pins 222 are disposed at the first side wall 212*a* and the third side wall 212*c*, and the third pins 222 conform to the USB 2.0 specification and the USB 3.0 specification. The fourth pins 224 are disposed at the second side wall 212*b* and the fourth side wall 212*d*, and the fourth pins 224 conform to the USB 3.0 specification.

In the present embodiment, a number of the third pins 222 is, for example, four, wherein two of the third pins 222 may be disposed at the first side wall 212*a*, and the other two third pins 222 may be disposed at the third side wall 212*c*. The third pins 222 may include a D+ pin (second D+ pin), a D− pin (second D− pin), a Vbus pin (second Vbus pin) and a ground pin (second ground pin). The D− pin and the Vbus pin may be disposed at the first side wall 212*a*, the D+ pin and the ground pin may be disposed at the third side wall 212*c*, and the D+ pin is opposite to the D− pin. Moreover, a number of the fourth pins 224 is, for example, four, wherein two of the fourth pins 224 may be disposed at the second side wall 212*b*, and the other two fourth pins 224 are disposed at the fourth side wall 212*d*. The fourth pins 224 may include a SSRX+ pin (second SSRX+ pin), a SSRX− pin (second SSRX− pin), a SSTX+ pin (second SSTX+ pin) and a SSTX− pin (second SSTX− pin). The SSRX+ pin and the SSRX− pin may be disposed at the fourth side wall 212*d*, and the SSTX+ pin and the SSTX− pin may be disposed at the second side wall 212*b*. Furthermore, the third pins 222 and the fourth pins 224 are electrically connected with the USB cable 50 which may be electrically connected to an electric product.

The USB plug 200 may further include a holder 230 holding the connection head 210, wherein the holder 230 has at least one locating part 232 (two are shown in FIG. 5). The locating part 232 is suitable for joining with a corresponding locating part, and thereby the USB plug 200 can be firmly fixed. The locating part 232 may be a locating hook.

In the present embodiment, the third pins 222 and the fourth pins 224 are disposed around the cavity 212, not disposed in a same plane, so a width of the USB plug 200 can be reduced. Therefore, the USB plug 200 of the present embodiment has a compact size. The USB plug 200 can be connected with the USB port 100, and a connection structure of the USB port 100 and the USB plug 200 will be described hereinafter.

Figure 7:
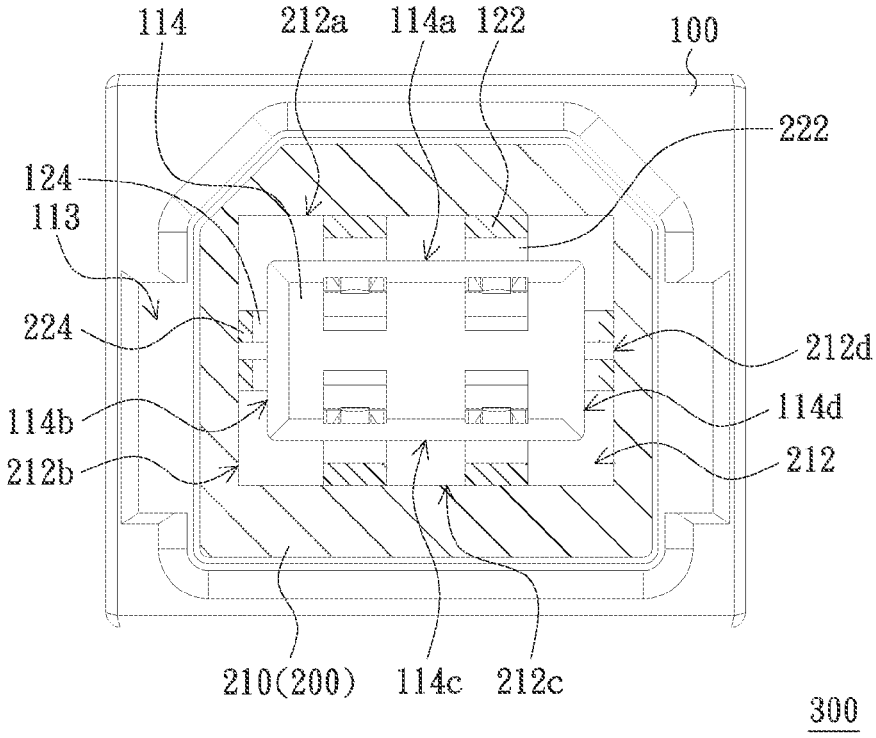
FIG. 7 is a schematic cross-sectional view of a connection structure of USB port and USB plug according to another embodiment of the present invention.

FIG. 7 is a schematic cross-sectional view of a connection structure of USB port and USB plug according to another embodiment of the present invention. The connection structure 300 includes the USB port 100 and the USB plug 200. The connection head 210 is inserted into the accommodation space 113 and the cavity 212 of the connection head 210 accommodates the pillar 114. The first side wall 212*a* of the cavity 212 corresponds to the first surface 114*a* of the pillar 114, the second side wall 212*b* of the cavity 212 corresponds to the second surface 114*b* of the pillar 114, the third side wall 212*c* of the cavity 212 corresponds to the third surface 114*c* of the pillar 114, and the fourth side wall 212*d* of the cavity 212 corresponds to the fourth surface 114*d* of the pillar 114. The third pins 222 are respectively connected with the first pins 122, and the fourth pins 224 are respectively connected with the second pins 124.

Moreover specifically, the first D+ pin and the second D+ pin are connected with each other, the first D− pin and the second D− pin are connected with each other, the first Vbus pin and the second Vbus pin are connected with each other, and the first ground pin and the second ground pin are connected with each other The first SSRX+ pin and the second SSRX+ pin are connected with each other, the first SSRX− pin and the second SSRX− pin are connected with each other, the first SSTX+ pin and the second SSTX+ pin are connected with each other, and the first SSTX− pin and the second SSTX− pin are connected with each other.

Figure 8:
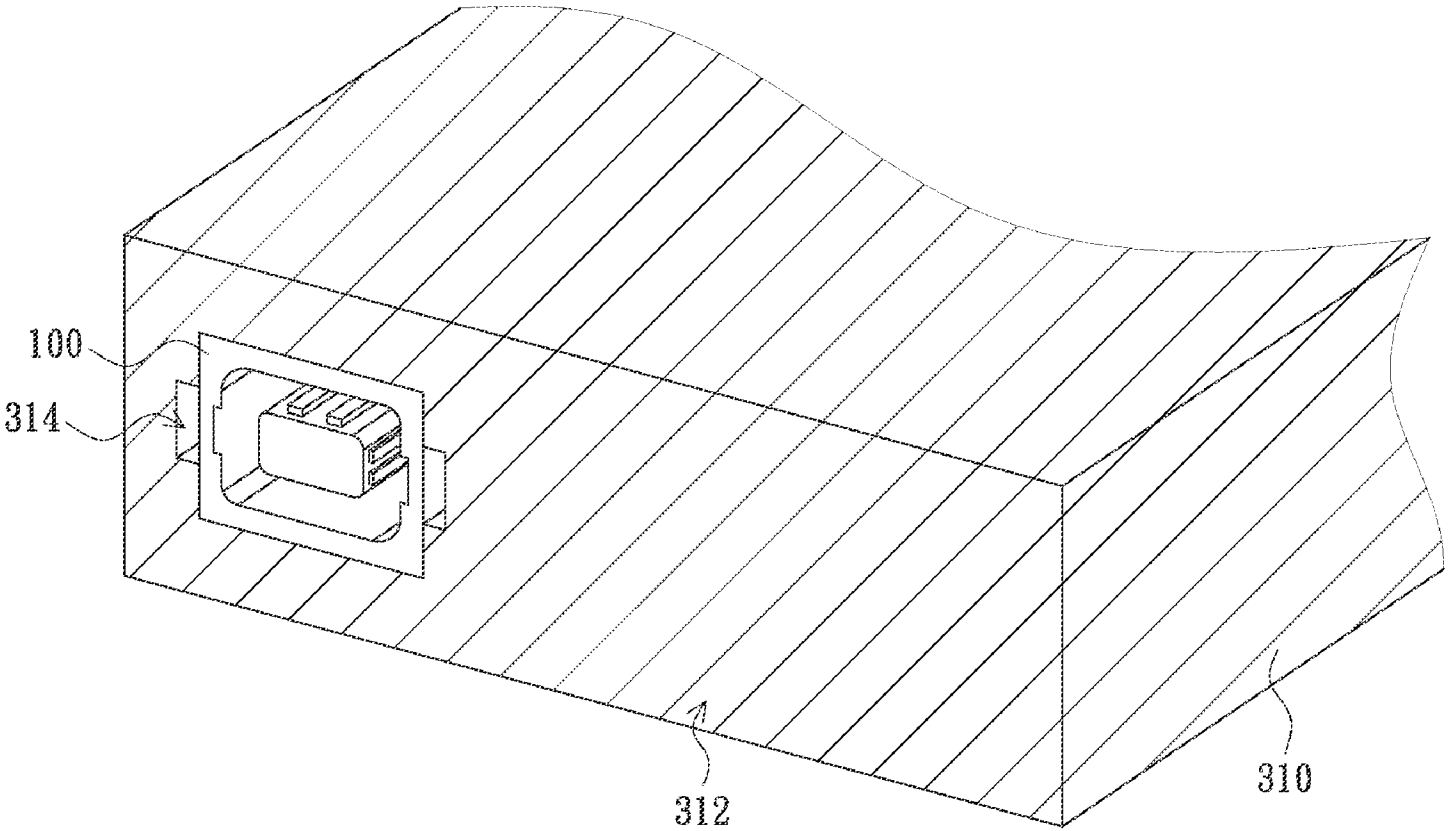
FIG. 8 is a schematic view of a USB port equipped with a shell according to another embodiment of the present invention.

Referring to FIGS. 5 and 8, the connection structure 300 may further includes a shell 310, wherein the USB port 100 is fixed at a side wall 312 of the shell 310. The side wall 312 of the shell 310 has at least one second locating part 314 (two are shown in FIG. 8) beside the USB port 100. The second locating parts 314 are joined with the first locating parts 232 when the USB plug 200 is connected with the USB port 100. In the present embodiment, the first locating parts 232 are, but not limited to, locating hooks, and the second locating parts 314 are, but not limited to, locating holes. The USB port 100 and the USB plug 200 can be firmly connected to each other due to the first locating parts 232 being joined with the second locating parts 314.

Because the USB port 100 and the USB plug 200 respectively have the compact size, the connection structure 300 of present embodiment can achieve a compact size.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A universal serial bus (USB) port, comprising:

a casing comprising a plurality of outer walls and a pillar, an accommodation space being formed between the outer walls, the pillar being disposed in the accommodation space, the casing having an opening exposing the pillar, the pillar having a first surface, a second surface adjacent to the first surface, a third surface opposite to the first surface, and a fourth surface opposite to the second surface;

a plurality of first pins disposed at the first surface and the third surface, and the first pins conforming to a USB 2.0 specification and a USB 3.0 specification; and a plurality of second pins disposed at the second surface and the fourth surface, and the second pins conforming to the USB 3.0 specification.

2. The USB port as claimed in claim 1, wherein a number of the first pins is four, two of the first pins are disposed at the first surface, and the other two first pins are disposed at the third surface.

3. The USB port as claimed in claim 1, wherein a number of the second pins is four, two of the second pins are disposed at the second surface, and the other two second pins are disposed at the fourth surface.

4. The USB port as claimed in claim 1, wherein each of the first pins and the second pins has a first end and a second end, the first ends of the first pins are disposed at the first surface and the third surface, the first ends of the second pins are disposed at the second surface and the fourth surface, and the second ends of the first pins and the second pins are extended outside the casing.

5. The USB port as claimed in claim 4, wherein a part of each of the first pins and the second pins outside the casing has a bending portion.

6. The USB port as claimed in claim 1, wherein the first pins comprise a D+ pin, a D− pin, a Vbus pin and a ground pin.

7. The USB port as claimed in claim 1, wherein the second pins comprise a SSRX+ pin, a SSRX− pin, a SSTX+ pin and a SSTX− pin.

8. A USB plug, comprising:

a connection head having a cavity and the cavity having a first side wall, a second side wall adjacent to the first side wall, a third side wall opposite to the first side wall, and a fourth side wall opposite to the second side wall;

a plurality of third pins disposed at the first side wall and the third side wall, and the third pins conforming to a USB 2.0 specification and a USB 3.0 specification; and a plurality of fourth pins disposed at the second side wall and the fourth side wall, and the fourth pins conforming to the USB 3.0 specification.

9. The USB plug as claimed in claim 8, wherein a number of the third pins is four, two of the third pins are disposed at the first side wall, and the other two third pins are disposed at the third side wall.

10. The USB plug as claimed in claim 8, wherein a number of the fourth pins is four, two of the fourth pins are disposed at the second side wall, and the other two fourth pins are disposed at the fourth side wall.

11. The USB plug as claimed in claim 8, wherein the third pins comprise a D+ pin, a D− pin, a Vbus pin and a ground pin.

12. The USB plug as claimed in claim 8, wherein the fourth pins comprise a SSRX+ pin, a SSRX− pin, a SSTX+ pin and a SSTX− pin.

13. The USB plug as claimed in claim 8 further comprising a holder holding the connection head, wherein the holder has at least one locating part.

14. The USB plug as claimed in claim 13, wherein the locating part is a locating hook.

15. A connection structure of USB port and USB plug, comprising:

a USB port, comprising:

a casing comprising a plurality of outer walls and a pillar, an accommodation space being formed between the outer walls, the pillar being disposed in the accommodation space, the casing having an opening exposing the pillar, the pillar having a first surface, a second surface adjacent to the first surface, a third surface opposite to the first surface, and a fourth surface opposite to the second surface;

a plurality of first pins disposed at the first surface and the third surface, and the first pins conforming to a USB 2.0 specification and a USB 3.0 specification;

a plurality of second pins disposed at the second surface and the fourth surface, and the second pins conforming to the USB 3.0 specification;

a USB plug connected with the USB port and comprising:

a connection head inserted into the accommodation space and having a cavity for accommodating the pillar, the cavity having a first side wall corresponded to the first surface of the pillar, a second side wall adjacent to the first side wall and corresponded to the second surface of the pillar, a third side wall opposite to the first side wall and corresponded to the third surface of the pillar, and a fourth side wall opposite to the second side wall and corresponded to the fourth surface of the pillar;

a plurality of third pins disposed at the first side wall and the third side wall, the third pins conforming to the USB 2.0 specification and the USB 3.0 specification, and the third pins being respectively connected with the first pins; and a plurality of fourth pins disposed at the second side wall and the fourth side wall, the fourth pins conforming to the USB 3.0 specification, and the fourth pins being respectively connected with the second pins.

16. The connection structure of USB port and USB plug as claimed in claim 15, wherein the first pins comprise a first D+ pin, a first D− pin, a first Vbus pin and a first ground pin, the third pins respectively comprise a second D+ pin, a second D− pin, a second Vbus pin and a second ground pin, the first D+ pin and the second D+ pin are connected with each other, the first D− pin and the second D− pin are connected with each other, the first Vbus pin and the second Vbus pin are connected with each other, and the first ground pin and the second ground pin are connected with each other.

17. The connection structure of USB port and USB plug as claimed in claim 15, wherein the second pins comprise a first SSRX+ pin, a first SSRX− pin, a first SSTX+ pin and a first SSTX− pin, the fourth pins comprise a second SSRX+ pin, a second SSRX− pin, a second SSTX+ pin and a second SSTX− pin, the first SSRX+ pin and the second SSRX+ pin are connected with each other, the first SSRX− pin and the second SSRX− pin are connected with each other, the first SSTX+ pin and the second SSTX+ pin are connected with each other, and the first SSTX− pin and the second SSTX− pin are connected with each other.

18. The connection structure of USB port and USB plug as claimed in claim 15 further comprising a shell, wherein the USB port is fixed at a side wall of the shell, the USB plug further comprises a holder for holding the connection head, the holder has at least one first locating part, and the side wall of the shell has at least one second locating part joined with the first locating part.

19. The connection structure of USB port and USB plug as claimed in claim 18, wherein the first locating part is a locating hook, and the second locating part is a locating hole.

20. The connection structure of USB port and USB plug as claimed in claim 15, wherein numbers of the first pins, the second pins, the third pins and the fourth pins are respectively four, two of the first pins are disposed at the first surface, the other two first pins are disposed at the third surface, two of the second pins are disposed at the second surface, the other two second pins are disposed at the fourth surface, two of the third pins are disposed at the first side wall, the other two third pins are disposed at the third side wall, two of the fourth pins are disposed at the second side wall, and the other two fourth pins are disposed at the fourth side wall.

* * * * *